US010406595B2

(12) United States Patent
Baginski et al.

(10) Patent No.: US 10,406,595 B2
(45) Date of Patent: Sep. 10, 2019

(54) METHOD FOR PRODUCING A RISER IN A CORE SHOOTER, AND CORE BOX SUITABLE FOR PERFORMING THE METHOD

(71) Applicant: GTP Schäfer Giesstechnische Produkte GmbH, Grevenbroich (DE)

(72) Inventors: Thomas Baginski, Leipzig (DE); Jörg Schäfer, Köln (DE); Thomas Schäfer, Frechen (DE)

(73) Assignee: GTP SCHAEFER GIESSTECHNISCHE PRODUKTE GMBH, Grevenbroich (DE)

( * ) Notice: Subject to any disclaimer, the term of this patent is extended or adjusted under 35 U.S.C. 154(b) by 0 days.

(21) Appl. No.: 15/760,218

(22) PCT Filed: Sep. 9, 2016

(86) PCT No.: PCT/EP2016/071292

§ 371 (c)(1),
(2) Date: Mar. 14, 2018

(87) PCT Pub. No.: WO2017/046007

PCT Pub. Date: Mar. 23, 2017

(65) Prior Publication Data

US 2018/0257132 A1 Sep. 13, 2018

(30) Foreign Application Priority Data

Sep. 14, 2015 (DE) ..... 10 2015 115 437

(51) Int. Cl.
*B22C 7/06* (2006.01)
*B22C 9/08* (2006.01)

(52) U.S. Cl.
CPC ..... *B22C 7/06* (2013.01); *B22C 9/088* (2013.01)

(58) Field of Classification Search
CPC ..... B22C 7/06; B22C 9/088
See application file for complete search history.

(56) References Cited

U.S. PATENT DOCUMENTS 4,858,673 A 8/1989 Campana et al.
2015/0283602 A1* 10/2015 Schafer ..... B22D 17/2023 164/137

FOREIGN PATENT DOCUMENTS

CN 102363205 A 2/2012
DE 29510068 U1 12/1996
(Continued)

*Primary Examiner* — Kevin P Kerns
*Assistant Examiner* — Steven S Ha
(74) *Attorney, Agent, or Firm* — Johnson, Marcou & Isaacs, LLC; Jennifer S. Stachniak

(57) ABSTRACT

In a method for producing a riser for inserting into a casting mold used for casting metals, the riser includes a riser body (31) surrounding an inner cavity (36) as a riser volume and is composed of an exothermic and/or insulating riser material (30). To produce a single-piece riser body (31) in a two-part core box (10), a cavity (14) reproducing the outer contour of the riser body (31) is formed and, in order to produce the inner cavity (36), a reversibly expandable king (15) is set in the cavity (14) in such a way that, in the shooting of the riser body (31), the wall region (32), the cup region (33), and the base region (34) of the riser body are formed by the riser material (30) introduced into the intermediate space (41) between the expanded king (15) and the inner wall (40) of the cavity (14).

12 Claims, 5 Drawing Sheets

(56) References Cited

FOREIGN PATENT DOCUMENTS

| | | | |
|---|---|---|---|
| JP | 11277182 | A | 10/1999 |
| JP | 2000288685 | A | 10/2000 |
| WO | 2014083155 | A1 | 6/2014 |

* cited by examiner

METHOD FOR PRODUCING A RISER IN A CORE SHOOTER, AND CORE BOX SUITABLE FOR PERFORMING THE METHOD

CROSS-REFERENCE TO RELATED APPLICATIONS

The instant application should be granted the priority dates of Sep. 9, 2016, the filing date of the International patent application PCT/EP2016/071292, and Sep. 14, 2015, the filing date of German Patent Application DE 10 2015 115 437.4

BACKGROUND OF THE INVENTION

The invention relates to a method for producing a riser for inserting into a casting mold used for casting metals, which riser consists of a riser body, which surrounds an inner cavity as a riser volume and is composed of an exothermic and/or insulating riser material, the riser body having a respective lateral wall region, a cover region, and a base region facing a mold cavity formed in the casting mold, wherein a riser opening is formed in the base region for connecting the inner cavity of the riser body with the mold cavity of the casting mold during the casting process and the inner cavity has, in at least a partial region, a diameter that is larger than the diameter of the riser opening, and wherein the riser body is produced by shooting in a core shooter. The invention further relates to a method for core box suitable for making a riser body for use in the core shooter.

In casting technology, it is often necessary to arranged additional risers in the casting molds, whose riser bodies fill with liquid metal during casting of the casting pieces and during solidification of the casting, compensate volume deficits that occur, in order to prevent formation of cavities in the casting piece. In this regard, the riser must be made, such that the liquid metal fed therein later solidifies as the casting piece, so that during the solidification process, a material transport to the casting piece can occur, which feeds the casting piece. In this connection, the riser is composed of an exothermic and/or insulating material. An important feature for the suitability of a riser is its riser module as a ratio of the riser volume to the surface of the riser, which is a geometrical ratio for the solidification rate of the metal introduced into the inner cavity of the riser during the casting process. The inner cavities of the risers frequently are cylindrically formed, which facilitates their manufacture in a core shooter, because the cylindrical shape of the inner cavity to be formed in the riser body means that there are no particular specifications for the formation of the corresponding shape for the core shooter. More advantageous with regard to the riser module, however, are inner cavities with a barrel or spherical design, wherein also more complicated cavity geometries can be sought based on considerations of casting technology, for example, with regard to a riser described in DE 295 10 068 U1.

Generally, these types of risers are related to a disadvantageously expensive manufacture, because the design of a cavity having an undercut design requires the use of corresponding core geometries in the shoot mold for making the riser when risers are manufactured in a core shooter. Since the unmolding of a riser body made as once piece from a shoot mold poses the problem of removing the core forming the inner cavity by means of the riser opening that has a smaller diameter than the inner cavity, such risers are made from two separate parts, which are combined to form a unitary riser body and connected to one another, preferably by adhesion.

SUMMARY OF THE INVENTION

The invention is therefore based on the object of providing a method as well as a core box for making a riser with the previously described design, by means of which with a simplified procedure, a one-piece riser body can be produced.

The invention elates to a method, in which, for making a one-piece riser body with the previously described design, a cavity reproducing the outer contour of the riser body is formed in a two-part core box with a bottom box and top box, and, in order to produce the inner cavity, a king, the outer contour of which can be reversibly expanded, is set in the cavity in such a way that, in the shooting of the riser body, the wall region, the cup region, and the base region of the riser body are formed by the riser metal introduced into the intermediate space between the expanded king and the inner wall of the cavity, wherein the riser opening arranged in the base region of the riser body is formed by a foot segment of the king, which foot segment specifies a first diameter, and the king does not protrude beyond the diameter of the foot segment in the non-expanded position of the king such that the completely shot riser body can be removed from the king by means of the riser opening of the riser body during the unmolding from the core box.

The present invention offers the advantage that the core technology for making the inner cavity of a riser body made in a core shooting method is replaced by the king expandable in its outer contour, wherein the space taken up by the expanded king forms the inner cavity of the finished, shot riser body within the cavity implemented in core boxes and reproduces the outer contour of the riser body. In this manner, the expansion of the king occurs specifically by means of a separate drive and is configured to be reversible, so that the king in connection to the shooting process, again assumes its original starting shape. Since the king, in its starting shape, that is in its non-expanded position, does not protrude over the diameter of its foot segment defining the riser opening, the riser body, upon unmolding from the king, is removable, wherein the riser body, with its riser opening, glides over the entire length of the king, or alternatively, the king is removable from the core box and therewith from the inner cavity of the riser body made during the shooting process, so that the riser body can be removed from the core box or from its bottom and upper boxes.

According to one example embodiment of the invention, the king comprises a fixed mandrel and a flexible membrane surrounding the mandrel. The membrane, after positioning the king in the cavity formed in the core box, is expanded by means of an enlargement of its diameter. The arrangement of the separate membrane comprised of a flexible material provides the possibility for an expansion of the king in a simple manner. Further, by means of the selected cutting shape of the membrane, a guideline for the design of the inner cavity of the subsequent riser body can occur, so that different contours of the inner cavity can be made of correspondingly made risers.

In a first embodiment of the invention, it is provided that in the intermediate space between the membrane and fixed mandrel, for intended expansion of the membrane, a gaseous or liquid medium is introduced and is released for unmolding of the shot riser body from the intermediate space. Thus, the medium acts as a separate drive.

In the process of a mechanical formation of the expandable king, it can be provided alternatively that in the intermediate space between the membrane and fixed mandrel, a spring element is arranged that extends over the length of the kind and is braced between two abutments associated with the mandrel, the diameter of the spring element being enlarged upon a reduction of the distance between the abutments and thereby, the outer lying membrane is selectively expanded, and the spring element resuming its original extended shape with subsequent enlargement of the distance to the starting position of the king. With this embodiment, the spring element acts as a separate drive for the expansion of the king. Thus it is possible, by reducing the distance between the abutments bracing the spring element, to provide a corresponding tensioning of the spring element, while in connection to the shooting process, the enlargement of the distance causes a restoration of the spring element into its starting position, in which also the king again assumes its original form In detail, it can be provided that the core box, its bottom box placed on a ground plate, is associated with a fixed base plate with the mandrel attached thereon and a vacuum plate movable relative to the base plate and the mandrel in the direction of the ground plate supporting the core box, the vacuum plate being movable along the mandrel into an opening disposed in the ground plate with a projection forming a first abutment for the spring element, and thereby reduces the distance to a second abutment formed on an upper end of the mandrel and causes the increase in diameter of the spring element.

In this connection, according to an exemplary embodiment of the invention, it is provided that the spring element encompassing the mandrel is braced with a respective flange formed on both ends against both abutments and the expandable membrane runs between the flanges of the spring element. In this regard, it can be provided that the membrane made of a flexible material is attached to the flanges of the spring element, so that the membrane follows the respective movements of the spring element.

According to a further embodiment of the invention, it is provided that the spring element comprises a common cage spring, which assumes its original shape automatically after a shape change caused by application of tensioning.

The invention further relates to a core box that is suitable for performing the manufacturing process, which comprises an upper box and a lower box as well a king that is adjustable in the core box; in this regard, it is provided in particular that the king is reversibly expandable in its outer contour by means of a drive.

In this connection, according to an example embodiment of the invention, the king comprises a fixed mandrel and a flexible membrane encompassing the mandrel. The membrane is expandable by means of an enlargement of its diameter.

In a first embodiment, it is provided that at the intermediate space between the fixed mandrel and the membrane, at least one line is connected, by means of which, for precise expansion of the king, a gaseous or liquid medium is conductible into the intermediate space and is releasable from the intermediate space.

Alternatively, in the intermediate space between the fixed mandrel and the membrane, for precise expansion of the king, a spring element is arranged, by means of whose pretensioning, the diameter of the membrane can be enlarged and by means of its subsequent tension release, the diameter of the membrane can be restored into the starting condition.

BRIEF DESCRIPTION OF THE DRAWINGS

In the drawings, an exemplary embodiment of the invention is provided, which will be described below. In the figures.

DETAILED DESCRIPTION OF SPECIFIC EMBODIMENTS

Figure 1:
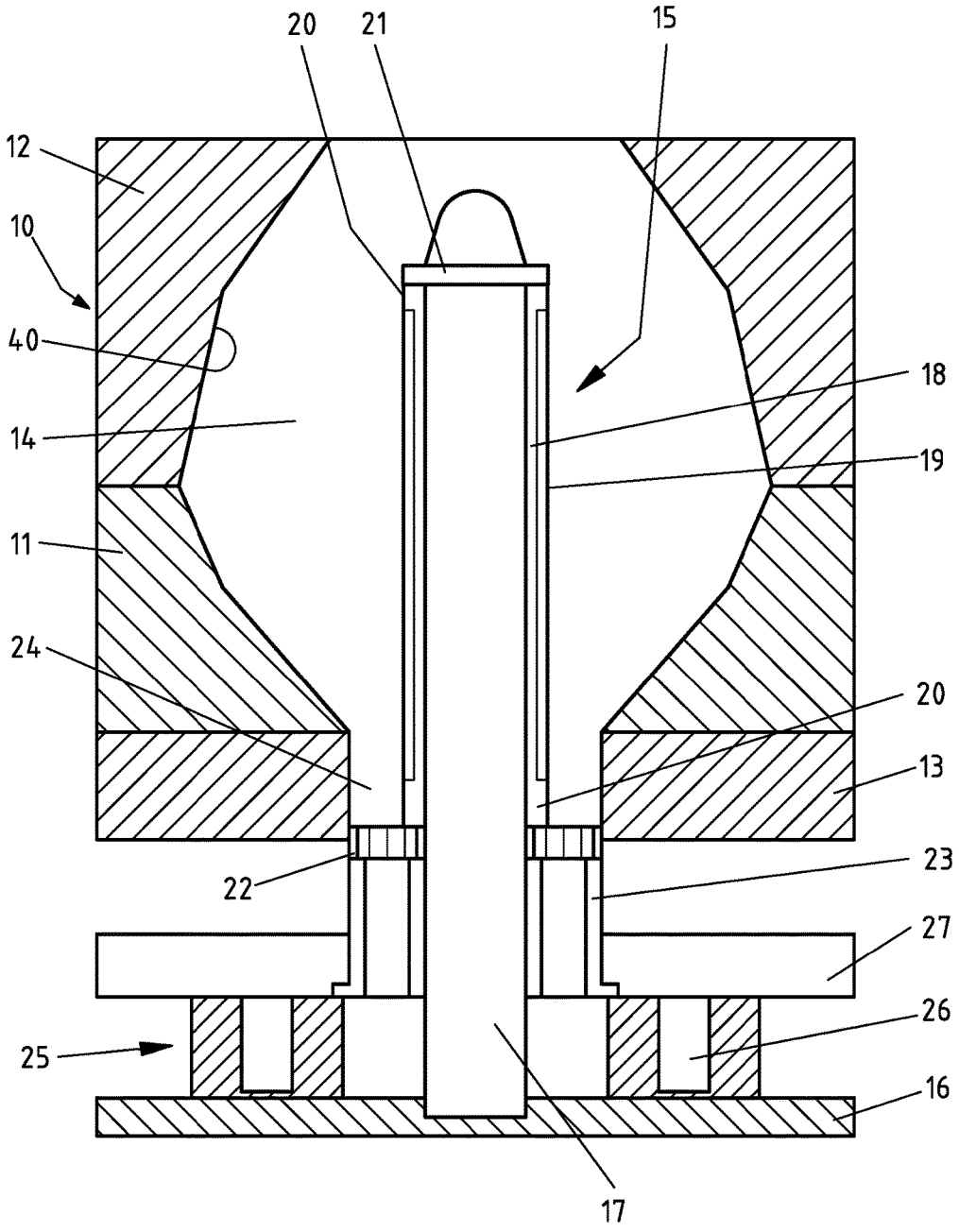
FIG. 1 shows a core box for shooting a riser body with a king associated with the core box before initiation of the shooting process.

The core box 10 shown schematically in FIG. 1 for making a riser body in a core shooting process comprises a bottom box 11 and a top box 12, wherein the core box 10 stands on a ground plate 13. In the interior of the core box, a common cavity 14 is formed in the bottom box 11 and top box 12, which reproduces the outer contour of the riser body to be made. A king 15 projects into this cavity, the king standing on a fixed base plate 16. The king 15 comprises a mandrel 17 fixedly connected with the base plate 16, a spring element 18 encompassing the mandrel 17, which in the embodiment shown, can be a common cage spring, and membrane 19 outwardly encompassing the spring element 18, the membrane 19 comprising a flexible material. The spring element 18 has, an respective upper and lower ends, a circumferential flange 20, wherein the membrane 19 extends between these flanges 20 and is attached to the flanges, such that the membrane 19 follows the respective movements of the spring element 18. In this regard, the spring element 18 acts as a separate drive for the intended expansion of the king 15.

A vacuum plate 27 is positioned between the base plate 16 and the ground plate 13 supporting the core box 10, the vacuum plate 27 being moveable in the direction of the core box 10 and being acted upon by a drive device 25 comprising correspondingly moveable thrust rods 26. The vacuum plate 27 has a projection 23, which projects into an opening 24 formed in the ground plate 13 and contacts the lower flange 20 of the spring element 18.

Figure 2:
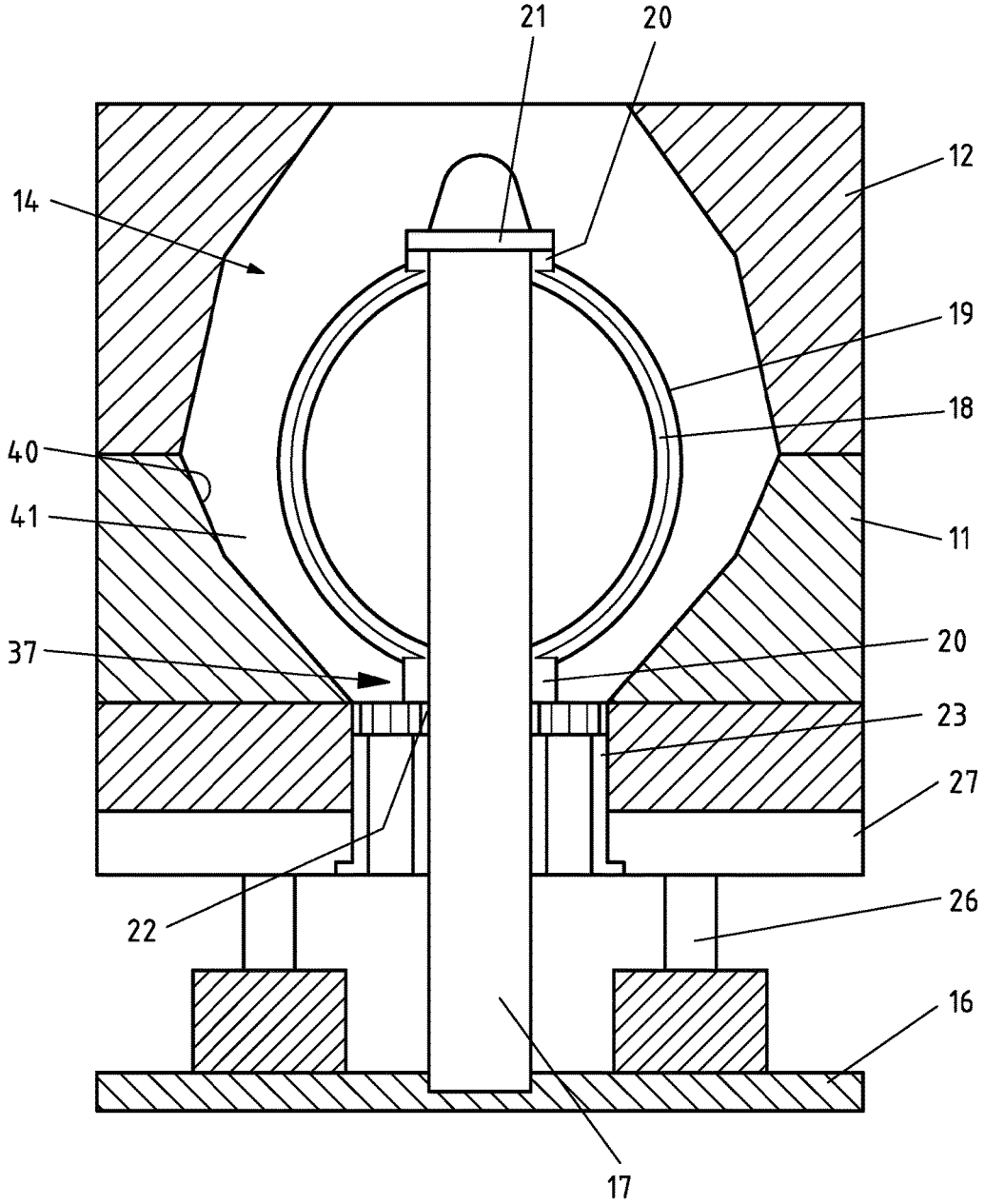
FIG. 2 shows the subject matter of FIG. 1 after operation of a vacuum plate and the expansion of the king caused thereby.

When now, before initiation of the shooting process corresponding to the representation in FIG. 2, the base plate 16 with the projection 23 is displaced along the mandrel 17 to the ground plate 13, then the projection 23 acts as a moveable first abutment 22 for the spring element 18. Since simultaneously, the spring element 18 on the upper end braces against a second, fixed abutment 21 disposed on the upper end of the mandrel 17, the distance between the two abutments 21, 22 is shortened, so that an increase of the diameter of the spring element 20 results. In this manner, the membrane 19 disposed on the spring element 18 expands accordingly, so that an intermediate space 41 between the inner wall 40 of the cavity 14 formed in the core box 10 and the outer contour of the expanded king 15 that was predetermined by the shape of the membrane 19 is provided. By means of this intermediate space, the design of the riser to be made with its riser body is predetermined.

Figure 3:
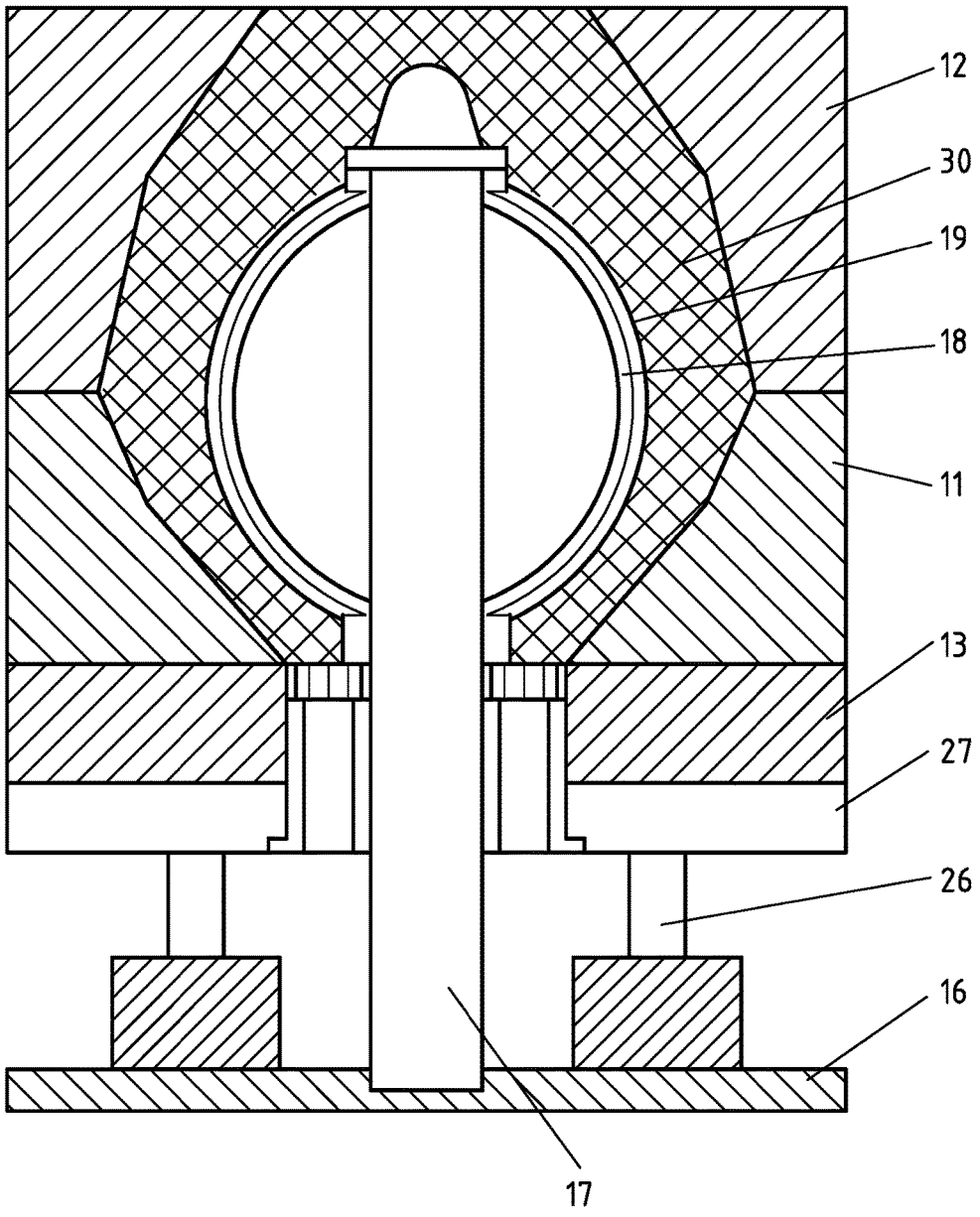
FIG. 3 shows the subject matter of FIG. 2 after shooting in of the riser material.

FIG. 3 shows that riser material 30 is shot into the noted intermediate space 41, which spreads in the intermediate space 41.

Figure 4:
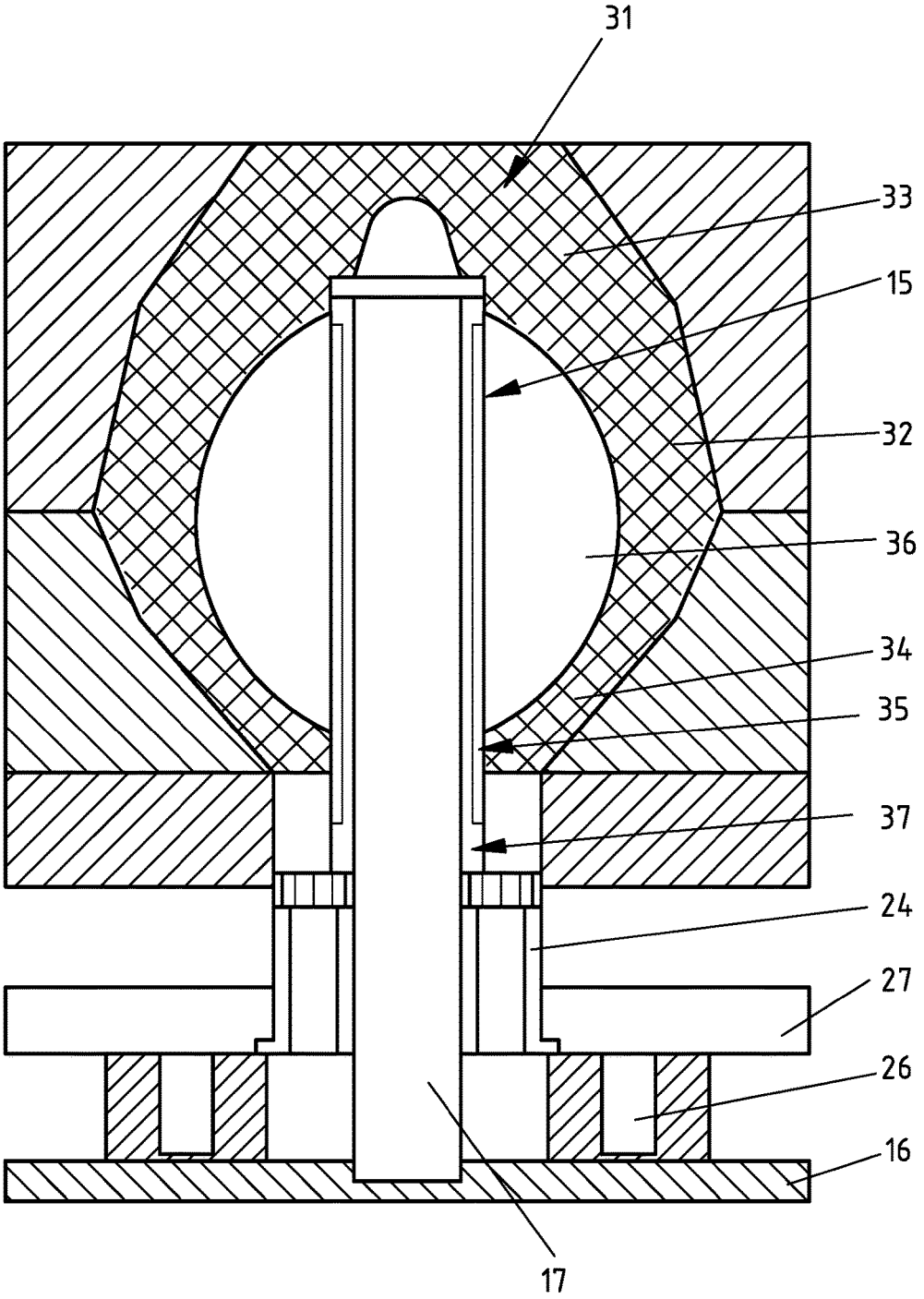
FIG. 4 shows the subject matter of FIG. 3 after reversal of the vacuum plate and the restoration of the king into its starting shape.

As can be seen further in FIG. 4, after completion of the shooting process, first the vacuum plate 27 is returned into its starting position according to FIG. 1, so that the distance between the upper abutment 21 and the movable abutment 22 formed on the projection 23 is increased. Based on this distance increase, the spring element's 18 tension can be released and the spring element 18 can assume again its extended position, whereby also the membrane 19 follows this movement, so that the king 15 assumes its non-expanded position. It is clearly visible that a riser body 31 with a lateral wall region 32, cap region, and base region 34 is formed, wherein the inner cavity 36 has an approximately spherical shape corresponding to the space taken up by the king in the expanded form according to FIG. 2. In the base region 34 of the riser body 31, a riser opening 35 is formed by the diameter of the foot segments 37 of the king 15 formed by means of the displaced lower flange 20 of the spring element 18.

Figure 5:
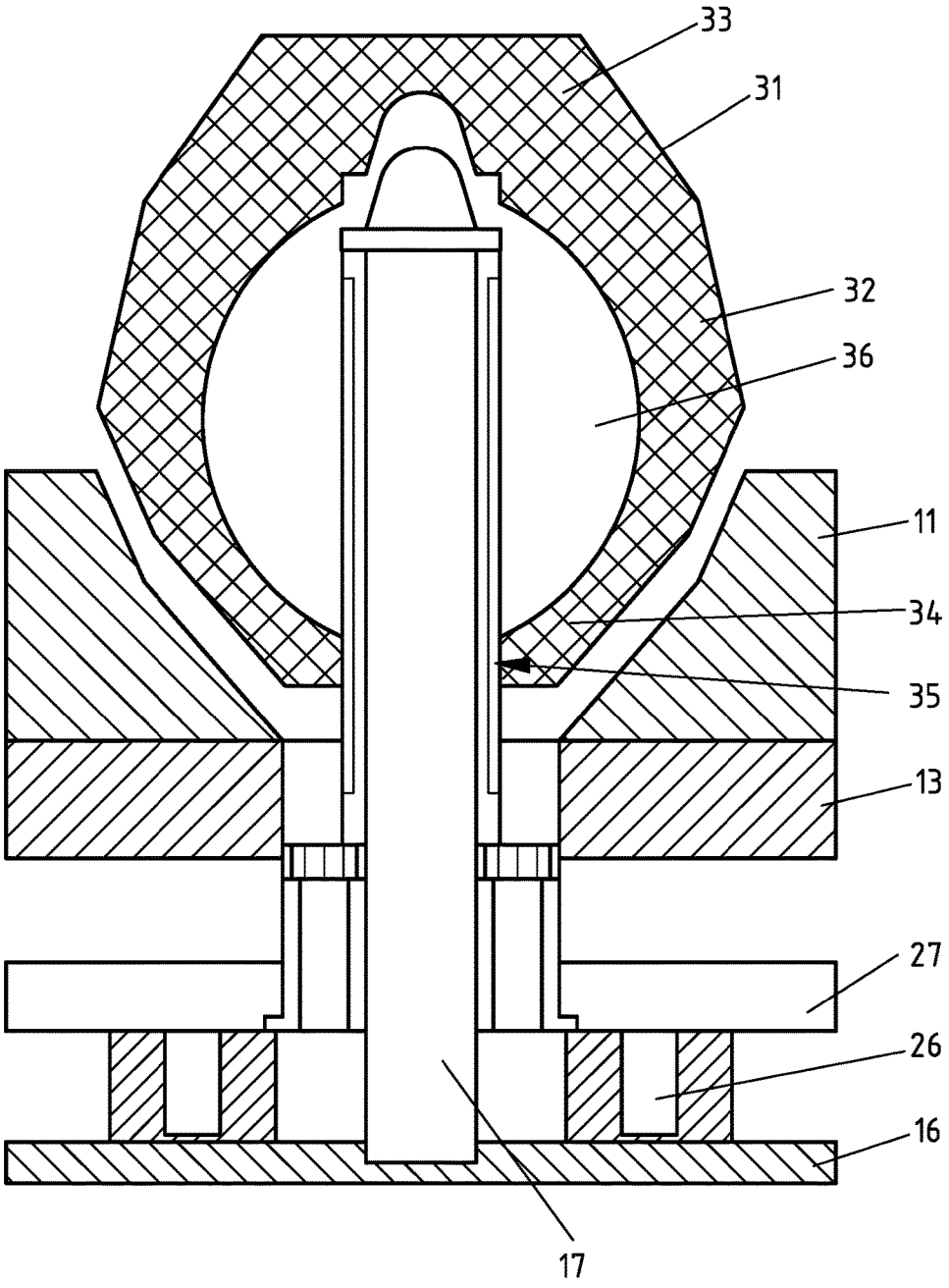
FIG. 5 shows the subject matter of FIG. 4 during unmolding of the shot riser body upon removal of the top box of the core box.

As shown in FIG. 5, after removal of the top box, the riser body 31 can be removed from the bottom box 11, wherein the riser opening 35 can glide over the length of the non-expanded king 15.

Although not shown further, it also can be provided that the intermediate space existing between the fixed mandrel 17 and the membrane 19 is expanded by means of a liquid or gaseous medium that can be introduced into the intermediate space, so that the outer diameter of the membrane 19 is increased accordingly and in this manner, the inner cavity servers as the riser volume of the riser body 31 is formed. In this regard, the liquid or gaseous medium acts as a separate drive for the intended expansion of the king 15. Thus, a corresponding, constructive simplification of the device required to perform the method, or the core box, is provided.

With the method according to the present invention as well as the core box constructed therefor, a one-piece manufacture of a riser body 31 is possible, despite a spherical shape, noted as an undercut design, of the inner cavity 36 of the riser body 31, without the necessity of additional placement or removal of cores for forming the inner cavity 36.

The features of the subject matter of this disclosure provided in the foregoing specification, the patent claims, the abstract and the drawings can be important individually as well as in any combination with one another for realization of the invention in its various embodiments.

The specification incorporates by reference the disclosure PCT/EP2016/071292, filed Sep. 9, 2016, and DE 10 2015 115 437.4, filed Sep. 14, 2015.

The present invention is, of course, in no way restricted to the specific disclosure of the specification and drawings, but also encompasses any modifications within the scope of the appended claims.

The invention claimed is:

1. A method for producing a single-piece riser body for inserting into a casting mold used for casting metals, the riser body (31) surrounding an inner cavity (36) as a riser volume and composed of an exothermic and/or insulating riser material (30), wherein a riser opening (35) is formed in a base region (34) of the riser body and the inner cavity (36) has, in at least a partial region, a diameter that is larger than a diameter of the riser opening (35), comprising the steps of:

providing a core box (10) comprising a bottom box (11) and a top box (12);

forming a cavity (14) in the core box (10) that reproduces an outer contour of the riser body (31);

positioning a king (15) in the cavity (14) of the core box (10), wherein an outer contour of the king (15) is reversibly expandable;

expanding the outer contour of the king (15);

producing the inner cavity (36) in such a way that during shooting of riser material to form the riser body (31), a wall region (32), a cap region (33), and the base region (34) of the riser body are formed by the riser material (30) introduced into an intermediate space (41) between the king (15) in the expanded state and an inner wall (40) of the cavity (14), wherein the riser opening (35) arranged in the base region (34) of the riser body (31) is formed by a foot segment (37) of the king (15), the foot segment defining a first diameter, wherein the king (15) does not protrude beyond the first diameter of the foot segment (37) in a non-expanded position of the king, such that a completely shot riser body (31) is removable from the king (15) through the riser opening (35) of the riser body during unmolding out of the core box (10).

2. The method according to claim 1, wherein the king (15) comprises a fixed mandrel (17) and a flexible membrane (19) encompassing the mandrel (17), wherein the membrane (19), after positioning of the king (15), is expanded in the cavity (14) formed in the core box (10) via enlargement of a diameter of the membrane.

3. The method according to claim 2, wherein, in an intermediate space between the membrane (19) and the fixed mandrel (17), a gaseous or liquid medium is introduced for expansion of the membrane (19) and is released from the intermediate space for removal of the shot riser body (31).

4. The method according to claim 2, wherein, in an intermediate space between the membrane (19) and the fixed mandrel (17), a spring element (18) is arranged that extends over a length of the king (15) and is braced between two abutments (21, 22) associated with the mandrel (17), wherein a diameter of the spring element (18) increases when a distance between the abutments (21, 22) decreases, and thereby the membrane (19) expands, and wherein the spring element (18) resumes an original extended form with a subsequent increase of a distance between the abutments (21, 22) to a starting position.

5. The method according to claim 4, wherein the bottom box (11) of the core box (10) is positioned on a ground plate (13), wherein the core box (10) is associated with a fixed base plate (16) with the mandrel (17) attached thereon and a stretch plate (27) movable relative to the base plate (16) and the mandrel (17) in a direction of the ground plate (13) supporting the core box (10), the stretch plate (27) being movable along the mandrel (17) into an opening (24) disposed in the ground plate (13) with a projection (23) forming a first abutment (22) for the spring element (18), thereby reducing a distance to a second abutment (21) formed on an upper end of the mandrel (17) and causing an increase in diameter of the spring element (18).

6. The method according to claim 4, wherein the spring element (18) encompassing the mandrel (17) braces with flanges formed on both ends of the spring element against both abutments (21, 22) of the mandrel (17) and the membrane (19) runs between the flanges (20) of the spring element (18).

7. The method according to claim 6, wherein the membrane (19) is attached to the flanges (20) of the spring element (18).

8. The method according to claim 4, wherein the spring element (18) is a cage spring.

9. A system for performing the method according to claim 1, comprising:

a core box (10) comprising a top box (12) and a bottom box (11), the top box (12) and the bottom box (11) forming a cavity with an inner wall (40) reproducing an outer contour of a riser to be produced; and a king (15), wherein the king (15) is positioned in the core box (10), and wherein the king (15) has an outer contour that is reversibly expandable to form an intermediate space (41) between the king (15) in an expanded state and the inner wall (40) of the cavity (14), the intermediate space for receiving riser material introduced therein.

10. The system according to claim 9, wherein the king (15) comprises a fixed mandrel (17) and a flexible membrane encompassing the mandrel (17), wherein the membrane (19) is expandable by means of an increase in a diameter of the membrane (19).

11. The system according to claim 10, wherein at least one line is connected at an intermediate space between the fixed mandrel (17) and the membrane (19), wherein a gaseous or liquid medium is introduced into the intermediate space and released from the intermediate space via the at least one line.

12. The system according to claim 10, further comprising a spring element (18) arranged in an intermediate space between the fixed mandrel (17) and the membrane (19), wherein, via tensioning of the spring element (18), the diameter of the membrane (19) is increasable and via subsequent release of tensioning of the spring element (18), the diameter of the membrane (19) is returnable into a starting state.

* * * * *